US008049149B2

(12) United States Patent
Geswender et al.

(10) Patent No.: US 8,049,149 B2
(45) Date of Patent: Nov. 1, 2011

(54) METHODS AND APPARATUS FOR AIR BRAKE RETENTION AND DEPLOYMENT

(75) Inventors: Chris E. Geswender, Green Valley, AZ (US); James D. Streeter, Tucson, AZ (US); Matthew A. Zamora, Tucson, AZ (US); Jason J. Fink, Tucson, AZ (US); Matthew O. Eisenbacher, Chandler, AZ (US)

(73) Assignee: Raytheon Company, Walthan, MA (US)

( * ) Notice: Subject to any disclaimer, the term of this patent is extended or adjusted under 35 U.S.C. 154(b) by 9 days.

(21) Appl. No.: 12/336,764

(22) Filed: Dec. 17, 2008

(65) Prior Publication Data

US 2009/0283627 A1 Nov. 19, 2009

Related U.S. Application Data

(60) Provisional application No. 61/054,082, filed on May 16, 2008.

(51) Int. Cl.
*F42B 10/50* (2006.01)
*F42B 10/00* (2006.01)

(52) U.S. Cl. ..... 244/3.29; 244/3.1; 244/3.15; 244/3.21; 244/3.24; 244/3.27; 244/3.28

(58) Field of Classification Search ..... 244/3.1–3.3, 244/110 R–110 H; 89/1.11; 102/501–529, 102/200, 206, 215, 335, 347, 348, 382, 386, 102/388

See application file for complete search history.

(56) References Cited

U.S. PATENT DOCUMENTS

| | | | | |
|---|---|---|---|---|
| 2,840,326 | A * | 6/1958 | Richardson et al. | 244/113 |
| 3,188,958 | A * | 6/1965 | Burke et al. | 244/3.14 |
| 3,228,634 | A * | 1/1966 | Chakoian et al. | 244/113 |
| 3,695,177 | A * | 10/1972 | Chakoian et al. | 102/388 |
| 4,083,308 | A * | 4/1978 | Levis | 102/215 |
| 5,826,821 | A | 10/1998 | Brandon et al. | |
| 6,310,335 | B1 | 10/2001 | Bonnet et al. | |
| 6,325,325 | B1 | 12/2001 | Bonnet et al. | |
| 6,386,112 | B1 * | 5/2002 | Shelton | 102/348 |
| 6,502,786 | B2 * | 1/2003 | Rupert et al. | 244/3.27 |
| 6,666,402 | B2 * | 12/2003 | Rupert et al. | 244/3.27 |
| 7,500,433 | B1 * | 3/2009 | Forrester | 102/501 |

FOREIGN PATENT DOCUMENTS

GB 2369420 A 5/2002

OTHER PUBLICATIONS

European Patent Office, International Searching Authority, "International Search Report," mailed Sep. 10, 2009; International Application No. PCT/US2009/043826, international filing date May 13, 2009.

* cited by examiner

*Primary Examiner* — Bernarr Gregory
(74) *Attorney, Agent, or Firm* — Ingrassia Fisher & Lorenz, P.C.

(57) ABSTRACT

Methods and apparatus for an air brake system for a projectile according to various aspects of the present invention comprises a pivot and a protrusion mounted on the pivot. The protrusion is adapted to selectively translate outward from the projectile around a translation axis that is parallel to the longitudinal axis of the projectile. The methods and apparatus may further operate in conjunction with an actuation system engaging the protrusion, wherein the actuation system is configured to selectively facilitate the translation of the protrusion.

20 Claims, 5 Drawing Sheets

METHODS AND APPARATUS FOR AIR BRAKE RETENTION AND DEPLOYMENT

CROSS-REFERENCE TO RELATED APPLICATIONS

This application claims the benefit of U.S. Provisional Patent Application No. 61/054,082, filed on May 16, 2008, and incorporates the disclosure of the application by reference.

BACKGROUND OF INVENTION

Various surfaces are used to facilitate control of a craft's direction while in flight. The ability to control flight characteristics produces a stable flight path and permits controlled guidance of the craft. Flight controls typically include ailerons, an elevator, and a rudder. Flight controls in projectiles however, may be as simple as a set of tail fins to maintain stable flight along a desired path.

Many projectiles are fired or launched through a tube or barrel, necessitating the need for control surfaces that do not impede the projectile's path during launch. To accommodate this requirement, projectiles often utilize deployable control surfaces that extend outwards from the projectile after launch making it necessary to control when and how these control surfaces deploy. Various methods have been used, including explosively actuated or spring loaded control surfaces.

SUMMARY OF THE INVENTION

Methods and apparatus for an air brake system for a projectile according to various aspects of the present invention comprises a pivot and a protrusion mounted on the pivot. The protrusion is adapted to selectively translate outward from the projectile around a translation axis that is parallel to the longitudinal axis of the projectile. The methods and apparatus may further operate in conjunction with an actuation system engaging the protrusion, wherein the actuation system is configured to selectively facilitate the translation of the protrusion.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

Figure 1:
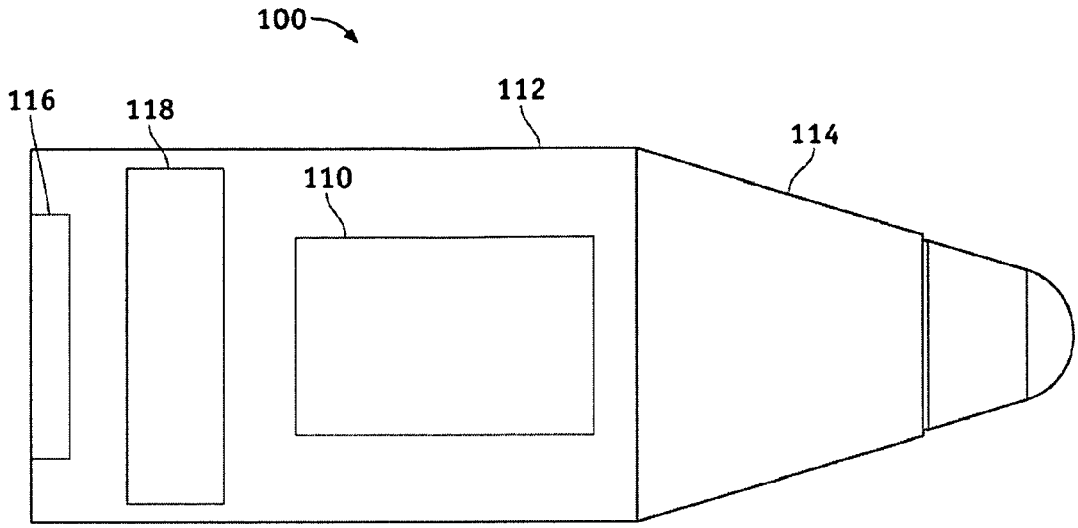
FIG. 1 representatively illustrates a projectile having a munition, a fuze, and a casing.

The present invention is described partly in terms of functional components and various methods. Such functional components may be realized by any number of components configured to perform the specified functions and achieve the various results. For example, the present invention may employ various techniques for reducing velocity, e.g., control surfaces, protrusions, and the like, which may carry out a variety of functions. In addition, the present invention may be practiced in conjunction with any number of missiles, artillery fuzes, bombs, or other projectiles, and the system described is merely one exemplary application for the invention. Further, the present invention may employ any number of conventional techniques for firing or launching projectiles, detonating warheads, navigating, and the like, and the system described is merely one exemplary application for the invention. Various representative implementations of the present invention may be applied to any system for explosive projectiles, such as missiles, bombs, artillery shells, and/or the like. Referring now to FIG. 1, methods and apparatus for a projectile 100 according to various aspects of the present invention may operate in conjunction with an air brake system. The projectile 100 may comprise any system that is configured to travel, either with an on-board propulsion system or ballistically, such as an artillery shell, bomb, or rocket. In one embodiment, the projectile 100 comprises an artillery shell including a munition 110, a casing 112, and a fuze 114. The projectile 100 may further comprise additional elements for the application or environment, such as a propulsion system 116 and/or a directional guidance system 118 to increase the probability of striking an intended target. The munition 110 comprises the explosive or incendiary elements of the projectile 100.

The casing 112 houses various elements of the projectile 100. The casing 112 may perform any appropriate functions for the application of the projectile 100, such as protecting the munition 110, propulsion system 116, and directional guidance system 118 from damage, allowing the projectile 100 to be safely handled, and providing an aerodynamic housing over the elements. The casing 112 can be made of any suitable material, such as metal, ceramic, carbon fiber, plastic or other material that sufficiently meets the requirements of a given use.

The propulsion system 116 may comprise any system that propels the projectile, for example to initiate the launch of the projectile 100 and/or propel the projectile 100 following initial launch or firing. In one embodiment, the propulsion system provides substantially longitudinal force, such as a conventional rear-mounted rocket motor. The propulsion system 116 may provide any appropriate forces to the projectile 100, such as lateral forces for guidance or longitudinal force for range control. For example, the propulsion system 116 may comprise a conventional rocket motor, or may be omitted altogether.

The fuze 114 selectively detonates the munition 110. The fuze 114 may ignite or otherwise cause detonation of the munition 110 in any appropriate manner, e.g., a timed fuze, contact detonator, proximity fuze, altitude fuze, or remote detonation. In the present embodiment, the fuze 114 comprises a multi-option fuze, such as a conventional fuze used in 105 mm and 155 mm artillery applications that screws into a fuze well formed in the casing 112.

The directional guidance system 118 steers the projectile 100, for example to guide the projectile 100 and/or increase accuracy. The directional guidance system 118 may comprise any system that facilitates altering the course of the projectile, such as tail fins, rudders, or impulse propulsion. The directional guidance system may further include other elements for guiding the projectile, such as GPS receivers, inertial guidance systems, control systems, and sensors for determining the position of the projectile 100 and/or adjusting the course of the projectile.

Figure 2:
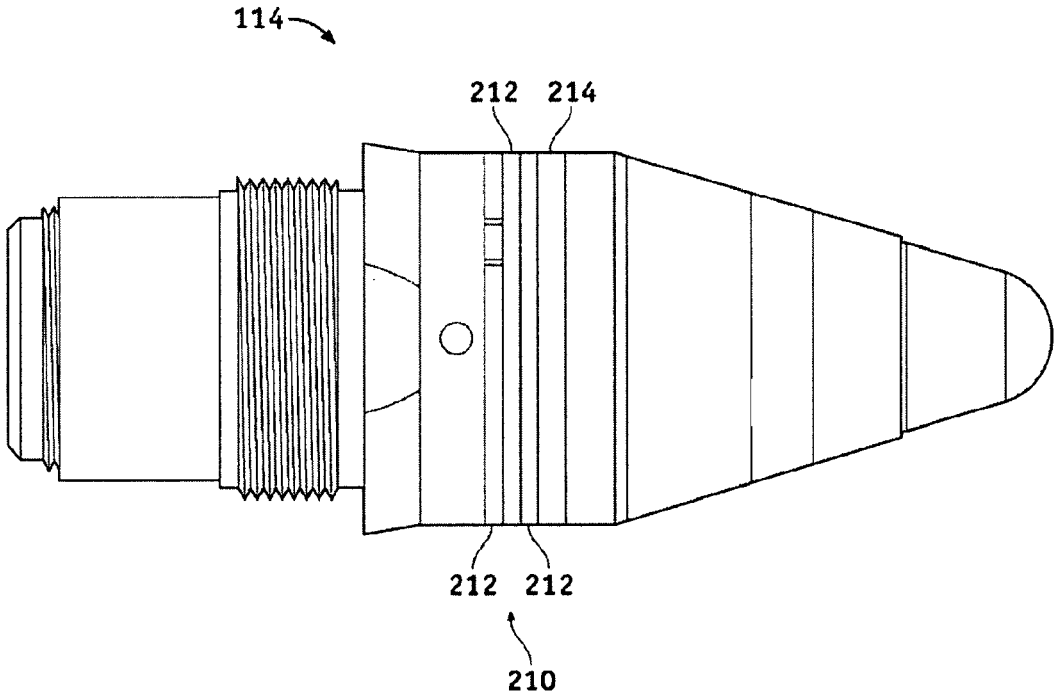
FIG. 2 is a diagram of a fuze having a radome, GPS antenna, air brake system, and a deployment system.

In the present embodiment, the directional guidance system 118 includes an air brake system 210. The air brake system 210 slows the projectile 100 in response to a trigger signal or event, such as a signal that the projectile 100 may overshoot its intended target. The air brake system 210 may be configured in any manner to increase the aerodynamic drag on the projectile 100 when deployed, such as an airflow obstacle to effectively increase the frontal surface area of the projectile 100 in the free air stream or otherwise slow the projectile 100. For example, referring to FIG. 2, an exemplary air brake system 210 comprises a deployment system 214 and one or more protrusions 212 that deploy by extending outward from the surface of the projectile 100.

Figure 4A:
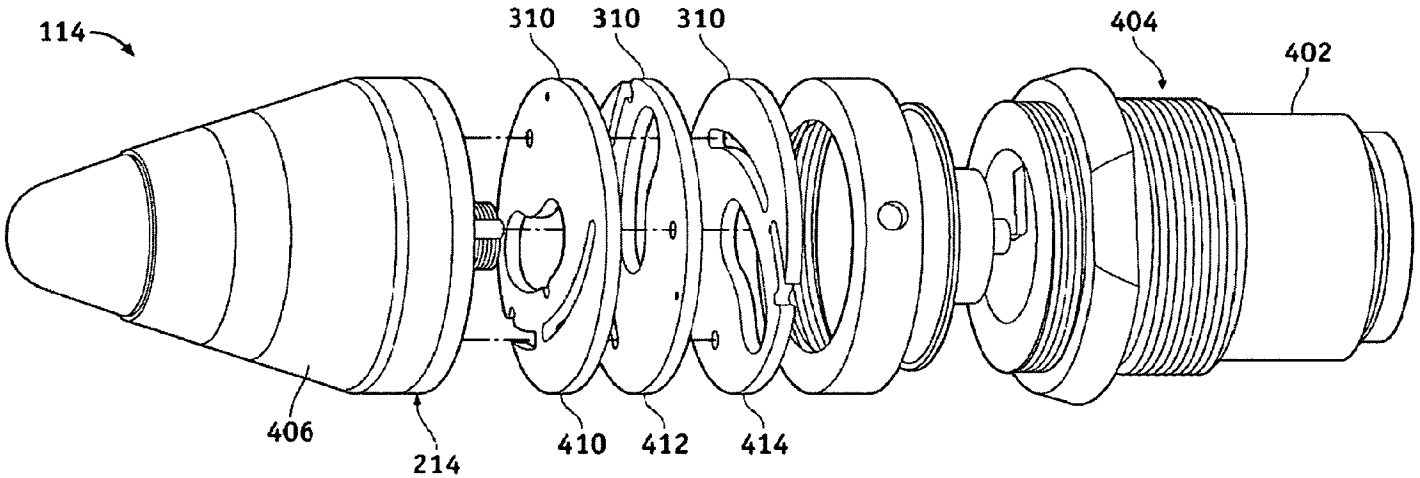
FIG. 4A is a diagram detailing how the air brake discs fit into the fuze in accordance with the exemplary embodiment of the present invention.
Figure 4B:
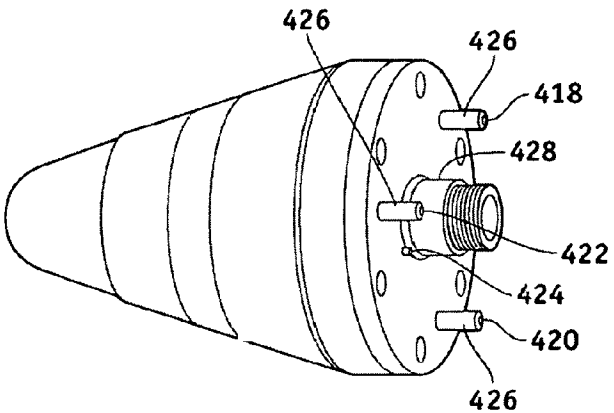
FIG. 4B is a diagram detailing the location of the fixed pins and the deployment pin on the fuze in accordance with the exemplary embodiment of the present invention.

The air brake system 210 may be integrated into or otherwise attached to other elements of the projectile 100 in any location, such as the casing 112. For example, the air brake system 210 may comprise an integrated component of the projectile 100, or may be retrofitted to preexisting projectiles 100. Referring now to FIGS. 4A and 4B, in the present embodiment, the air brake system 210 is integrated into the fuze 114, and may be screwed into the fuze well defined by the casing 112. In one embodiment, the fuze 114 comprises a base structure 402 comprising a threaded connector 404 to engage the fuze well of the projectile 100 and a central connector column 428 connecting the base structure 402 to a nose 406.

Figure 3A:
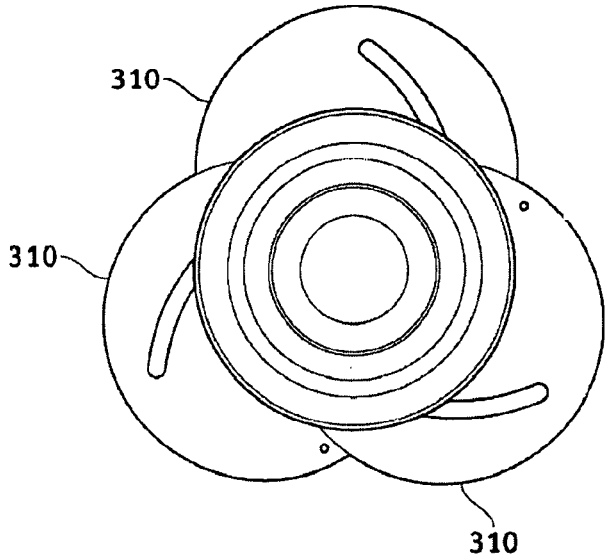
FIG. 3A is a drawing showing a front view of the deployed condition of the air brake system in accordance with the exemplary embodiment of the present invention.
Figure 3B:
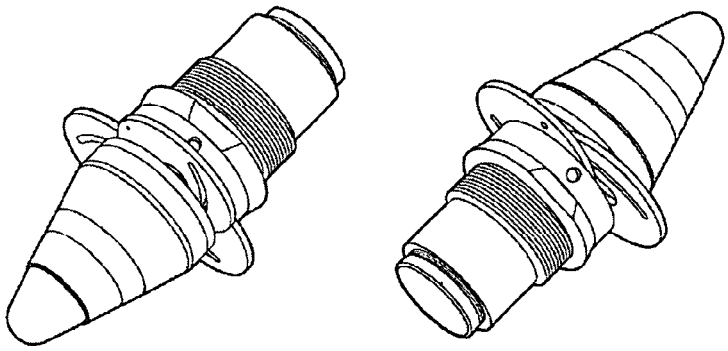
FIG. 3B is a drawing showing the deployed condition of the air brake system in accordance with the exemplary embodiment of the present invention.
Figure 3C:
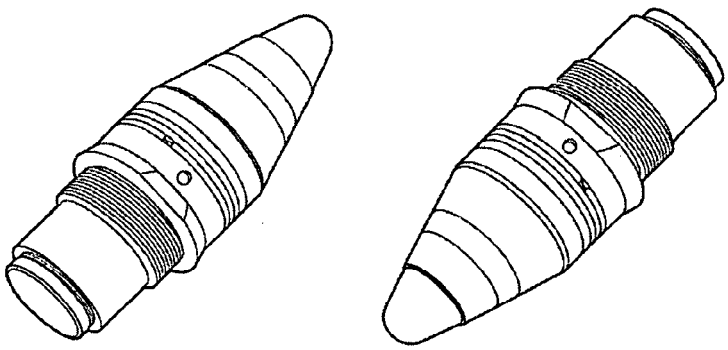
FIG. 3C is a drawing showing the stowed condition of the air brake system in accordance with the exemplary embodiment of the present invention.

The protrusions 212 selectively extend into the free air stream while the projectile 100 is in motion and may be configured in any suitable manner to effectively increase the drag on the projectile 100. For example, the protrusions 212 may include flat plates, round discs, fins, or spoilers. The protrusions 212 may also be set at any angle relative to the direction of the projectile 100 after they are extended into the air stream. For example, referring to FIGS. 3A-C, the protrusions 212 may comprise three circular air brake discs 310 that extend out from the projectile 100 under centrifugal force in response to a signal.

The protrusions 212 may comprise any suitable material for a particular projectile 100 application and/or environment. For example, the material may comprise metal, ceramic, composite material such as carbon graphite or Kevlar, or other sufficiently rigid material. In the present artillery-fired embodiment, the three air brake discs 310 comprise a heat-treated stainless steel.

The protrusions 212 may be extended from the projectile 100 in any suitable manner such as by spring tension, piston actuation, or explosive force. Deployment of the protrusions 212 may also comprise a stepped or modulated procedure, wherein the protrusions 212 are not fully deployed but instead deployed partially, such as continuously or in increments, based on the amount of velocity reduction required for the projectile 100.

The protrusions 212 may be configured in any suitable manner that allows the protrusions 212 to extend into the air stream and increase the drag on the projectile 100. The movement of each of the protrusions 212 is around at least one pivot that at least partially controls the translated movement of at least one of the protrusions 212. The pivot may be configured in any suitable manner to allow the protrusions 212 to extend outward from the projectile 100.

Figure 6A:
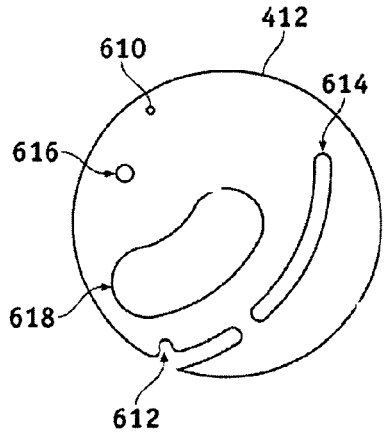
FIG. 6A is a diagram of the air brake disc which is installed in the middle position in accordance with the exemplary embodiment of the present invention.
Figure 6B:
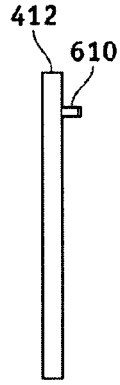
FIG. 6B is a side view of FIG. 6A.
Figure 7A:
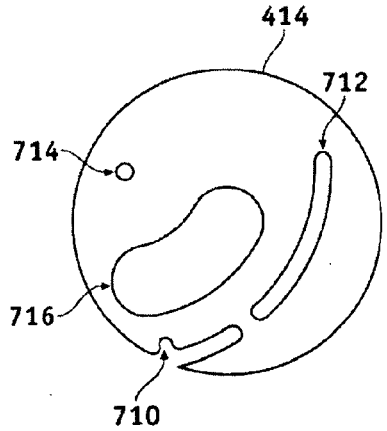
FIG. 7A is a diagram of the furthest aft air brake disc in accordance with the exemplary embodiment of the present invention.
Figure 7B:
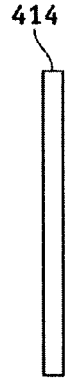
FIG. 7B is a side view of FIG. 7A.

Referring to FIGS. 4A and 4B, in the present embodiment, the air brake discs 310 are configured to rotate about a set of fixed pins 426. For example, a circular opening on each air brake disc 310 may facilitate the outward translation of the air brake discs 310 by rotating about one of the fixed pins 426. For example, referring to FIGS. 5A and 5B, a forward disc 410 comprises a circular opening 518 that is configured to fit over one of the fixed pins 426. The opening 518 is set such that the center of rotation of the forward disc 410 is not centered along the longitudinal axis of the projectile 100. Referring to FIGS. 4A, 6 and 7, a middle disc 412 and an aft disc 414 are similarly configured to rotate about one of the fixed pins 426 such that no fixed pin 426 has more than one air brake disc 310 which rotates about it. Each air brake disc 310 is further configured to allow rotation about one of the fixed pins 426 but not have that rotation impeded by the remaining fixed pins 426.

Translation of the air brake discs 310 outward is accomplished by a channel beginning at the edge of the air brake discs 310. For example, referring to FIG. 5A, the forward disc 410 further comprises a channel 522 configured to accommodate one of the fixed pins 426. The middle disc 412 and the aft disc 414 may be similarly configured with a channel to accommodate a fixed pin 426.

In the present embodiment, the amount of rotation is controlled by an arc shaped opening on the forward disc 410, the middle disc 412, and the aft disc 414. For example, referring to FIG. 5A, the forward disc 410 further comprises an arc shaped opening 516 that is configured to fit around one of the fixed pins 426. The length of the opening determines the amount of rotation and sets a maximum amount that the forward disc 410 can translate out into the air stream. For example, the arc shaped opening 516 may limit the rotation of the forward disc 410 to seventy-five degrees. In an alternative embodiment, the arc shaped opening 516 may be configured to allow a series of intermediate rotations such that the area of the forward disc 410 that is exposed to the free stream air velocity is controlled. The middle disc 412 and the aft disc 414 are similarly configured such that all three airbrake discs 310 have the same amount of rotation.

Referring to FIG. 4B, in the present embodiment, the fixed pins 426 comprise a first pin A 418, a second pin B 420, and a third pin C 422 and are set 120 degrees apart along a corresponding radial distance from a common center point. This configuration sets the center of rotations of the three air brake discs 310 also 120 degrees apart. Alternate points of rotation may be incorporated either by non-circular disc protrusions 212, more or less than three protrusions 212, or rotation points that do not all lie on a similar radial distance from the center line of the projectile 100.

The forward disc 410, the middle disc 412, and the aft disc 414 are further configured to allow the projectile 100 to be fully assembled and not impede the translation of the air brake discs 310. For example, referring to FIG. 5A, the forward disc 410 further comprises a large opening 520 configured to allow a central threaded connector column of the fuze 114 to attach to the projectile 100 fuze well and accommodate the rotation of the forward disc 410.

The air brake discs 310 may further comprise a locking system to retain the air brake system 210. The air brake system 210 may comprise any system to retain the air brake discs 310, such as locking tabs or segmented pins. For example, in the present embodiment, the locking system comprises several small pins and notches configured into the air brake discs 310.

Figure 5A:
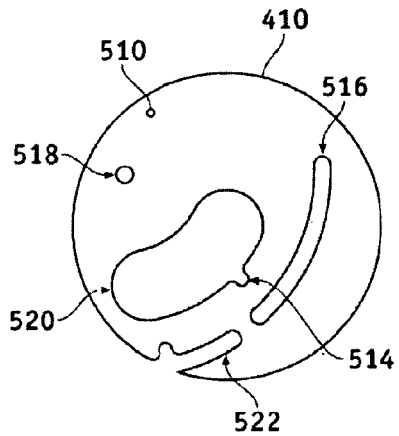
FIG. 5A is a detailed drawing of an air brake disc in accordance with the exemplary embodiment of the present invention.
Figure 5B:
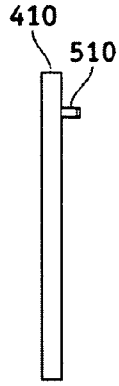
FIG. 5B is a side view of FIG. 5A.

More specifically, referring to FIG. 5A, the forward disc 410 further comprises a notch 514 that engages the deployment system 214 and prevents the forward disc 410 from rotating until deployment is desired. The middle disc 412 and the aft disc 414 of the present embodiment are held in a retained position by a series of pins and notches. Referring to FIGS. 5A, 5B, 6A, and 6B, in the present embodiment for example, the forward disc 410 further comprises an interference pin 510 that is configured to engage the an interference notch 612 on the middle disc 412. The interference pin 510 prevents rotation of the middle disc 412 until the forward disc 410 begins to rotate. Referring now to FIGS. 6A and 7A, the middle disc 412 and the aft disc 414 are further configured such that a second interference pin 610 on the middle disc 412 engages a second interference notch 710 and prevents the aft disc 414 from rotating until the middle disc 412 begins to rotate.

The deployment system 214 maintains retention of the air brake system 210 until a command to deploy is initiated. After a command to deploy is received by the deployment system 214, it releases the air brake system 210 allowing the protrusions 212 to extend out from the projectile 100. The deployment system 214 may be configured in any way to prevent undesired movement of the protrusions 212. For example, the deployment system 214 may comprise a block that is configured to maintain system retention such as a bolt, a lock, a pin, a tab, or a movable element.

Figure 8:
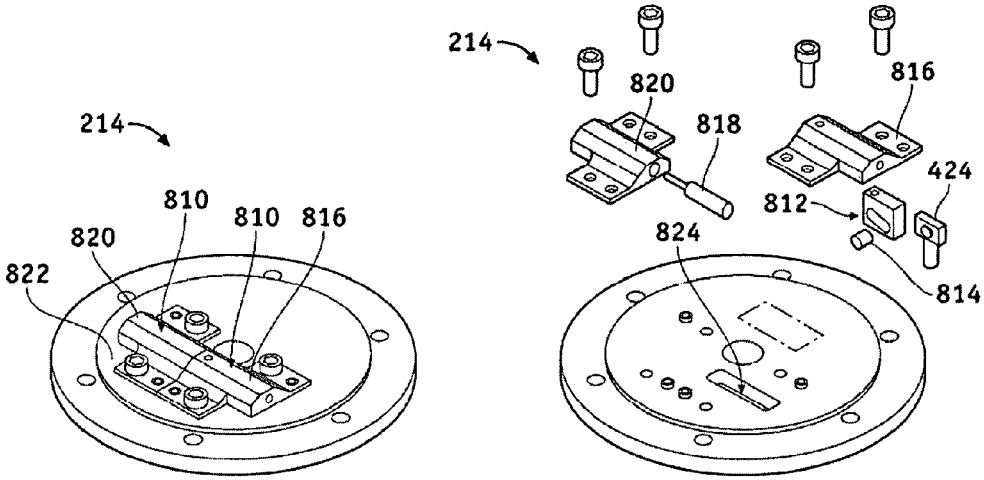
FIG. 8 is an exploded view of the deployment system and the aft plate assembly displaying how they are connected in accordance with the exemplary embodiment of the present invention.

For example, referring now to FIGS. 4A, 4B, and 8 of the present embodiment, the deployment system 214 further comprises a deployment pin 424 that prevents rotation of the forward disc 410, an actuator system 810 configured to move the deployment pin 424, and an actuator plate assembly 822. The deployment pin 424 is housed within the actuator system 810 and the actuator system 810 is connected to the actuator plate assembly 822.

The deployment pin 424 acts as a lock on the air brake discs 310 preventing undesired rotation. The deployment pin 424 may be configured in any manner to prevent rotation. The deployment pin 424 may comprise any suitable material such as metal or plastic. For example, referring to FIGS. 4B and 8 in the present embodiment, the deployment pin 424 is a headless pin made of a heat treated stainless steel alloy that extends through the actuator plate assembly 822 and into notch 514 of the forward disc 410. Alternatively, the deployment pin 424 may not be configured as a pin but may comprise such elements as a block, screw, rivet, hook, rod, tab, or clip as long as it functions as a way to prevent rotation of at least one air brake disc 310.

The actuator system 810 disengages the deployment pin 424 from the air brake discs 310. The actuator system 810 may comprise any system for disengaging the deployment pin 424 such as a spring loaded pin removal device or a system that shears off the deployment pin 424. In the present embodiment, the actuator system 810 disengages the deployment pin 424 by using a piston actuated sliding block.

Referring to now FIG. 8 of the present embodiment, the actuator system 810 comprises the deployment pin 424, a slider block 812, a slider pin 814, a deployment pin housing 816, a piston actuator 818, and a piston support 820. The deployment pin 424 is connected to the slider block 812 via the slider pin 814 and contained within the deployment pin housing 816. The deployment pin housing 816 is affixed to the actuator plate assembly 822. The piston actuator 818 is contained within the piston support 820. The piston support 820 is affixed to the actuator plate assembly 822 adjacent to the deployment pin housing 816. This example is only one of the ways in which the elements may be combined in order to move the deployment pin.

The slider block 812 connects to the deployment pin 424 and facilitates its movement. The slider block 812 may comprise any suitable system for engaging the deployment pin 424 such as a spring loaded system or a cantilevered system. Referring to FIG. 8, the slider block 812 in the present embodiment, disengages the deployment pin 424 by moving laterally along a slider block recess 824 in the actuator plate assembly 822 in a direction that is normal to the movement of the deployment pin 424.

Figure 9A:
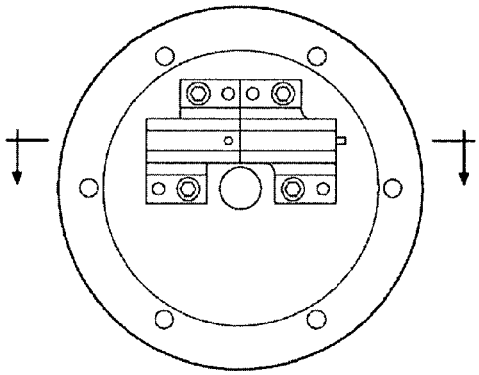
FIG. 9A is a top view of the aft plate assembly.
Figure 9B:
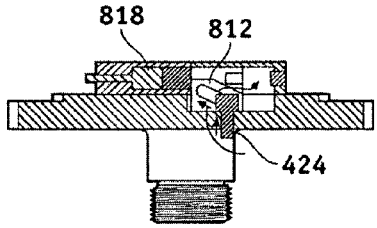
FIG. 9B is a diagram detailing how the actuation system moves the deployment pin in accordance with the exemplary embodiment of the present invention.

More specifically, referring now to FIG. 9B, disengagement of the deployment pin 424 is accomplish by an angled channel on the slider block 812 that facilitates movement of the deployment pin 424 out of the notch 514 of the forward disc 410 while the slider block 812 moves in a direction that is 90-degrees opposed to the movement of the deployment pin 424.

The slider pin 814 connects the deployment pin 424 to the slider block 812. The slider pin 814 may comprise any system of connecting the slider pin 814 to the slider block 812. For example, referring to FIG. 8 in the present embodiment, the slider pin 814 connects the deployment pin 424 to the slider block 812 through a corresponding opening at one end of the deployment pin 424 that is configured to fit within the slider block 812. The slider pin 814 is further configured to run along the angled channel in the slider block 812 and facilitate the movement of the deployment pin 424.

The deployment pin housing 816 secures the slider block 812 and deployment pin 424 to the actuator plate assembly 822. The deployment pin housing 816 may comprise any suitable system of securing the slider block 812 and deployment pin 424 to the actuator plate assembly 822. In the present embodiment, the deployment pin housing 816 comprises a cover that is secured to the actuator plate assembly 822 and is configured such that it substantially covers the slider block 812 and deployment pin 424.

Figure 10:
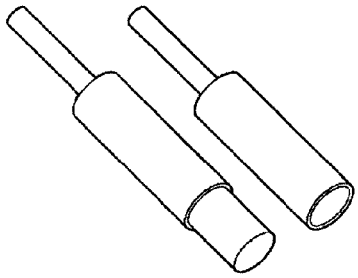
FIG. 10 is a diagram of the piston actuator in the actuated state and in the non-actuated state.

The piston actuator 818 moves the slider block 812 causing the deployment pin 424 to disengage from the forward disc 410. In the present embodiment, the piston actuator 818 engages the slider block 812 through an opening in the side of the deployment pin housing 816. The piston actuator 818 causes the slider block 812 to move laterally along the slider block recess 824. Referring to FIG. 10, the present embodiment of the piston actuator 818 is an electrically actuated explosive device ("EED"). When actuated, one end of the EED extends outward engaging the slider block 812 moving it laterally in the same direction. Alternate methods of moving the slider block 812 may include using a solenoid piston, a spring activated device that acts on the slider block, or a motorized system to either move the slider block 812 or disengage the deployment pin 424 without the use of a slider block 812.

The actuator plate assembly 822 connects the actuator system 810 to the air brake system 210. The actuator plate assembly 822 may be configured in any manner that will allow the actuator system 810 to engage the air brake system 210. The actuator plate assembly 822 may be made of any suitable material for a given projectile 100 application. For example, the material may comprise metal, ceramic, composite material such as carbon graphite or Kevlar, or other sufficiently rigid material. In the present artillery-fired embodiment, actuator plate assembly 822 is comprised of a steel alloy.

In operation, a projectile 100 is fired at a target and a precision guidance kit (PGK) acts to increase the accuracy of the projectile 100 while in flight. Increasing the accuracy of the projectile 100 may comprise any suitable method such as the use of navigational systems and control surfaces to make course corrections during flight. In the present embodiment, the air brake system 210 increases the drag on the projectile 100 to reduce the velocity affecting the ultimate range of the projectile 100.

During flight, the PGK tracks the trajectory of the projectile 100 and determines the optimum point for the air brake system 210 to be deployed. When the optimal point is reached an electronic signal is sent to the deployment system 214 and the deployment pin 424 is disengaged from the air brake system 210. The disengagement of deployment pin 424 allows centrifugal force to act on the air brake system 210 causing a set of air brake discs 310 to translate outward from the projectile 100 and into the free air stream increasing the drag.

More particularly, once the deployment pin 424 is disengaged, a forward disc 410 begins to rotate and as it does an interference pin 510 affixed to the forward disc 410 disengages from a middle disc 412 allowing it to begin rotation. As the middle disc 412 begins to rotate, an interference pin 610 affixed to the middle disc 412 disengages from an aft disc 414 allowing it to begin rotation. Centrifugal force then acts on the air brake discs 310 causing them to rotate and translate into the free air stream. The air brake discs 310 are then held in place by centrifugal force for the remainder of the projectile 100 flight.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments, however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. An air brake system for a projectile having a longitudinal axis, comprising:

a pivot;

a protrusion rotatably coupled to the pivot and adapted to selectively extend outward from the projectile around an axis, wherein the axis is parallel to the longitudinal axis of the projectile; and an actuation system engaging the protrusion, wherein the actuation system is configured to selectively facilitate the outward extension of the protrusion.

2. An air brake system of claim 1, further comprising a surface defining a channel on the protrusion, wherein the channel is configured to control the amount of extension of the at least one protrusion.

3. An air brake system of claim 2, wherein:

the channel is arc shaped;

the channel is closed; and the channel is slideably seated around the pivot.

4. An air brake system of claim 1, further comprising a connector coupled to the protrusion and adapted to engage the projectile.

5. An air brake system for a projectile having a longitudinal axis comprising:

a pivot;

a protrusion coupled to the pivot and adapted to selectively translate outward from the projectile around a translation axis, wherein the translation axis is parallel to the longitudinal axis of the projectile; and an actuation system engaging the protrusion, wherein the actuation system is configured to selectively facilitate the translation of the protrusion, wherein the actuation system comprises a selectively movable block engaging the protrusion, and wherein a movement of the block facilitates translation of the protrusion.

6. An air brake system of claim 5, further comprising a locking system, wherein the locking system is configured to prevent translation of a second protrusion until the block is moved.

7. An air brake system according to claim 6, wherein the locking system comprises:

an interference pin affixed to the first protrusion; and an interference notch defined in the second protrusion, wherein the interference notch is configured to receive the interference pin.

8. An air brake system for an artillery projectile having a longitudinal axis, comprising:

a plurality of fixed pins aligned substantially parallel to the longitudinal axis of the projectile;

a plurality of air brake discs, wherein each air brake disc is rotatably mounted on one of the plurality of fixed pins;

a deployment pin inhibiting rotation of at least one of the plurality of air brake discs; and an actuation system engaging the deployment pin, wherein the actuation system is configured to move the deployment pin and allow at least one of the plurality of air brake discs to rotate about at least one of the plurality of fixed pins.

9. An air brake system of claim 8, wherein the actuation system comprises:

a slider block connected to the deployment pin; and a piston actuator engaging the slider block, wherein the piston actuator is configured to move the slider block.

10. An air brake system of claim 8, further comprising a locking system connected to at least one of the brake discs, wherein the locking system inhibits rotation of the at least one of the plurality of air brake discs until the deployment pin is moved by the actuation system.

11. An air brake system according to claim 10, wherein the locking system comprises:

an interference pin affixed to a first brake disc; and an interference notch on a second air brake disc configured to receive the interference pin.

12. An air brake system of claim 11, wherein at least one of the air brake discs further comprises a surface defining a channel, wherein:

the channel is open at a first end and closed on a second end; and the surface defining the channel defines the interference notch.

13. An air brake system of claim 8, further comprising a surface defining a guide channel on at least one of the plurality of air brake discs, wherein the guide channel limits the rotation of the at least one air brake disc.

14. An air brake system of claim 13, wherein:

the guide channel is arc shaped;

the guide channel is closed on both ends; and the guide channel is slideably seated around one of the plurality of fixed pins.

15. An air brake system of claim 8, wherein the plurality of fixed pins are distributed evenly around the longitudinal axis of the projectile and affixed at identical radial distances from the longitudinal axis.

16. An air brake system of claim 8, further comprising a base structure, comprising:

a connector adapted to connect the projectile; and a central column coupled to the connector, wherein the air brake discs are disposed around the central column.

17. An airbrake system for a projectile having a longitudinal axis and a fuze well, comprising:

a connector adapted to engage the fuze well;

a central column coupled to the connector;

a housing coupled to the central column;

a plurality of pins coupled to the housing and disposed parallel to the longitudinal axis;

a plurality of round rigid discs disposed adjacent each other in a stack, wherein each disc is rotatably coupled to one of the plurality of pins such that the disc selectively rotates around the pin and around a rotation axis parallel to the longitudinal axis, wherein each disc comprises:

a surface defining a central aperture, wherein the central column is disposed through the central aperture of each disc:

an open-ended channel adapted to slidably receive at least one pin of the plurality of pins;

an arc-shaped opening adapted to slidably receive at least one pin of the plurality of pins; and wherein the plurality of round discs comprises:

a first disc, comprising:

a surface defining a deployment notch; and a first disc interference pin;

a second disc, comprising:

a second disc interference notch adapted to selectively retain the first interference pin; and a second disc interference pin; and a third disc, comprising a third disc interference notch adapted to selectively retain the second interference pin; and an actuation system, comprising:

a deployment pin selectively engaging the deployment notch of the first disc; and a selectively movable block engaging the deployment pin and adapted to move the deployment pin from the deployment notch.

18. An airbrake system according to claim 17, wherein the actuation system further comprises a piston actuator engaging the block, wherein the piston actuator is configured to move the slider block.

19. An airbrake system according to claim 17, wherein the first disc rotates in response to centrifugal force when the deployment pin moves from the deployment notch.

20. An airbrake system according to claim 17, where movement of the first disc displaces the first disc interference pin from the second disc interference notch.

* * * * *